United States Patent [19]

Franklin

[11] Patent Number: 4,704,935

[45] Date of Patent: Nov. 10, 1987

[54] STRINGED MUSICAL INSTRUMENT

[76] Inventor: Paulie H. Franklin, 712 May Dr., Madison, Tenn. 37115

[21] Appl. No.: 914,823

[22] Filed: Oct. 3, 1986

[51] Int. Cl.[4] ..... G10D 3/14

[52] U.S. Cl. ..... 84/312 P; 84/294; 84/297 R

[58] Field of Search ..... 84/270, 294, 295, 297 R, 84/297 S, 298, 307, 312 R, 312 P

[56] References Cited

U.S. PATENT DOCUMENTS

| | | | |
|---|---|---|---|
| 2,025,875 | 12/1935 | Loar | 84/307 X |
| 3,233,495 | 2/1966 | Bernardi | 84/294 |
| 3,353,433 | 11/1967 | Webster | 84/307 X |
| 4,141,271 | 8/1979 | Mullen | 84/312 P |
| 4,342,249 | 8/1982 | McCormick et al. | 84/312 P |

*Primary Examiner*—Benjamin R. Fuller
*Attorney, Agent, or Firm*—Harrington A. Lackey

[57] ABSTRACT

A stringed musical instrument of a resonator guitar type, including an elongated, substantially horizontal, hollow body supporting pegs, a fret board, and a resonator in which each of the string members includes an elongated string, an elongated rigid string bar and a string cable, connected end-to-end. The strings extend over and lightly engage a transverse bridge, while the rigid string bars bear against a transverse support rod adjacent the bridge. The cables are connected to tuning lever members independently pivotally mounted upon a transverse tuning shaft at the tail end of the body. Operative members, such as pedals and/or knee levers are connected by linkages to the tuning lever members for controlling the tension in the strings.

11 Claims, 10 Drawing Figures

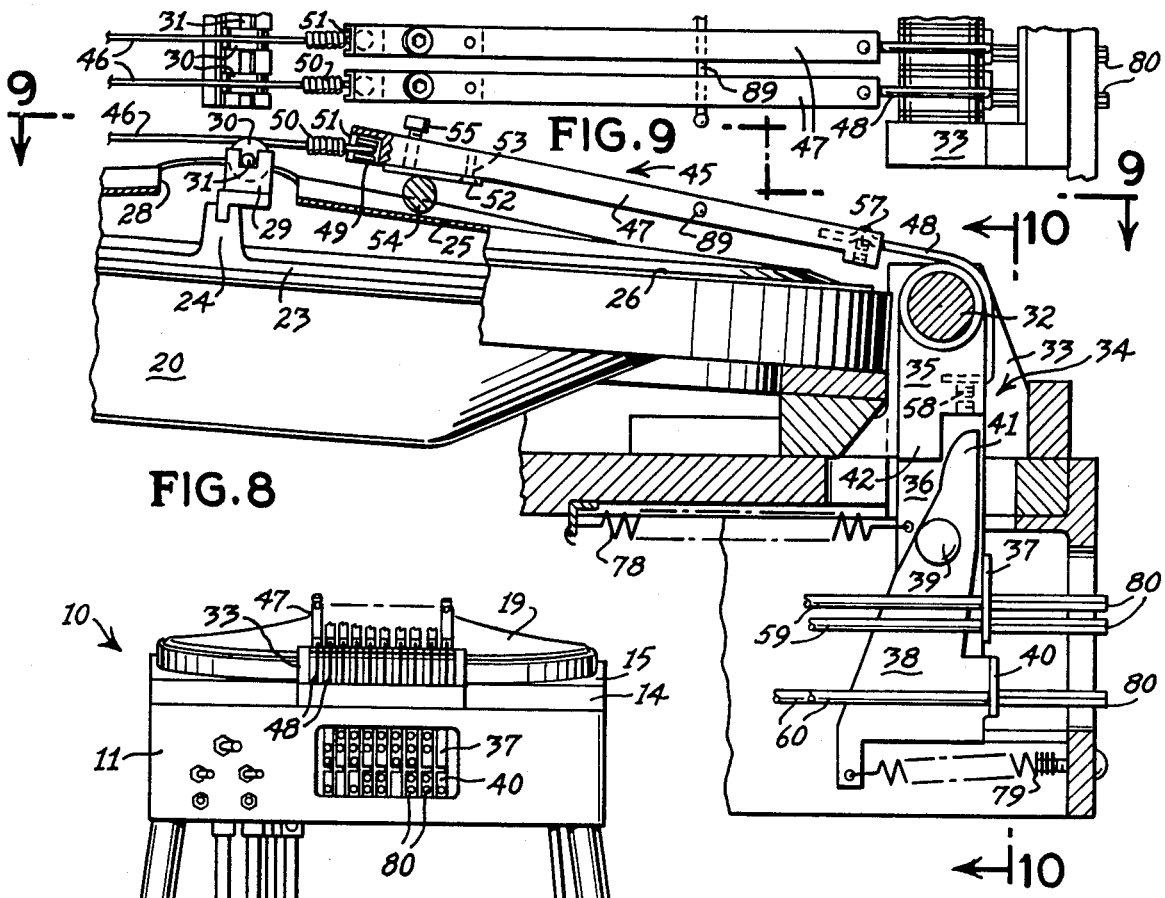
FIG. 9
FIG. 8
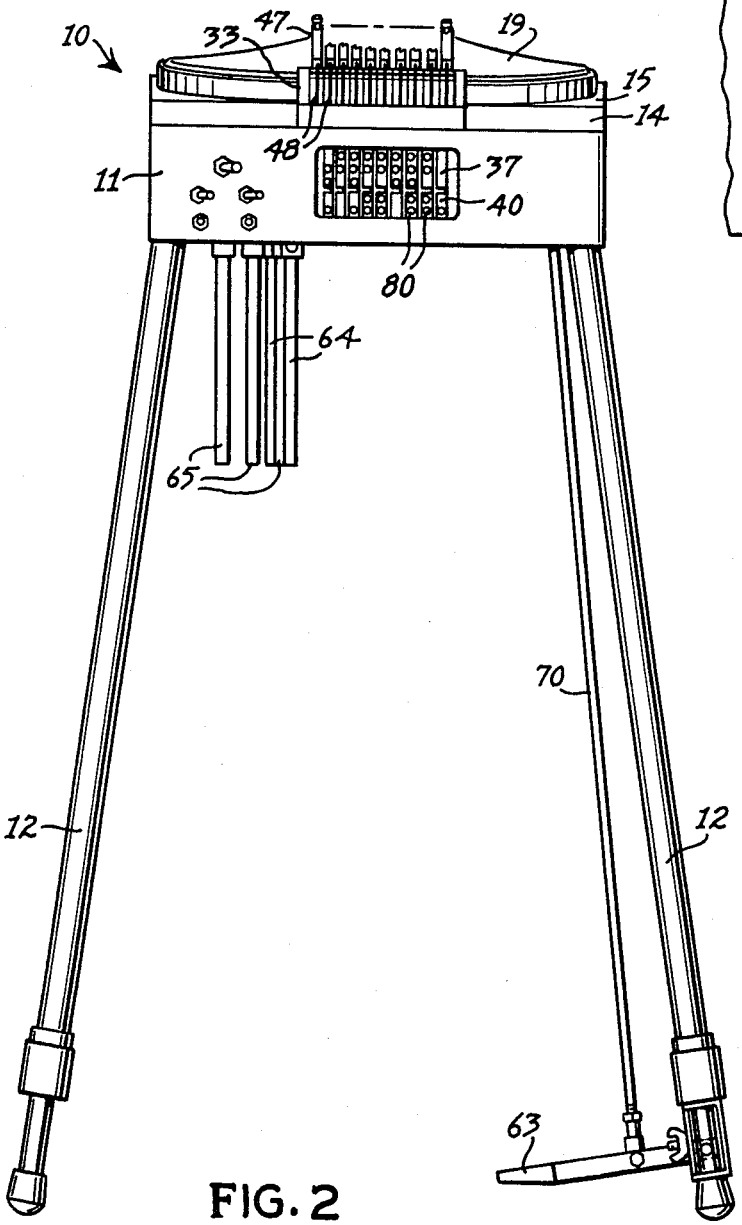
FIG. 2
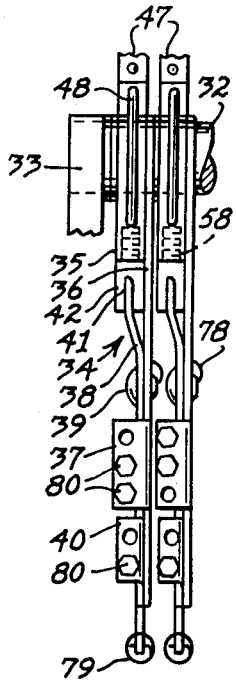
FIG. 10

STRINGED MUSICAL INSTRUMENT

BACKGROUND OF THE INVENTION

This invention relates to a table-mounted, substantially horizontal, stringed musical instrument, and more particularly to a resonator guitar in which the tuning structure for the strings has been improved.

Stringed musical instruments mounted substantially horizontal upon tables and having elongated strings mounted for operative tuning by pedals or knee levers, are well known in the art. One such stringed musical instrument is the pedal steel guitar, in which pedals and knee levers are connected mechanically to the strings to change the tension in the strings and therefore the tone of the instrument. The pedal steel guitar is an electrical guitar, provided with an electrical pick-up and an amplifier, as opposed to an acoustical guitar incorporating a resonator.

In the above pedal steel guitars, the strings extend the full length of the body of the instrument and are bent sharply about the bridge of the instrument. Thus, the movement of the strings by vibration from playing, and by tuning adjustments, create chafing between the strings and the bridge, ultimately resulting in string breakage.

Another stringed musical instrument, known in the trade as a "Do-Bro", is an acoustical guitar with a resonator in the body of the guitar protected by a perforated cover. The instrument is held by the performer against his body or on his lap and played with picks and bars as a conventional acoustical guitar. The "Do-Bro" does not utilize pedals or knee levers to activate the strings, which are fixed upon the instrument.

SUMMARY OF THE INVENTION

It is therefore an object of this invention to provide a stringed musical instrument, of a table-top resonator guitar type, in which the string and string support structure have been altered in order to improve their wear resistance and the tonal quality of the instrument.

A stringed musical instrument made in accordance with this invention includes an elongated hollow sound box or body supporting on its top surface a head in which are mounted the conventional tuning or string pegs, an elongated fret board, and a resonator supporting a transverse bridge. Each of the string members includes in series an elongated flexible string, an elongated rigid string bar, and a string cable, connected end-to-end. The strings are extended from the pegs across the bridge and connected to one end of the respective string bars. The string bars are supported in substantial alignment with the strings and bear against an elongated transverse support bar adjacent the bridge. Thus, most of the pressure exerted by the string members upon the instrument body is transmitted by the string bars to the transverse support rod and not to the bridge. The cables attached to the other ends of the string bars are connected to, and partially wrapped about, a plurality of tuning levers, independently and pivotaly movable about a transverse tuning shaft. The tuning levers are then connected to an actuator mechanism including a plurality of link rods connected through various linkages to pedals and knee levers for independently varying the tension in the string members.

In a preferred form of the invention, the hollow body has a substantially horizontal flat top surface with the portion of the top surface supporting the resonator tapering downward toward the end of the body supporting the transverse tuning shaft. The sloping of the top surface is not only for appearance, but primarily to shorten the length of the string members.

The utilization of the rigid string bars bearing against the transverse support rod minimizes the wear in the strings, as well as reduces the pressure of the strings against the bridge and the resonator to provide an improved quality of musical tones and longer-lasting strings.

BRIEF DESCRIPTION OF THE DRAWINGS

FIG. 2 is a right end elevation of the instrument disclosed in FIG. 1;

FIG. 8 is a greatly enlarged fragmentary sectional elevation of the right end portion of the instrument disclosed in FIG. 6;

FIG. 9 is a fragmentary top plan view taken along the line 9—9 of FIG. 8; and FIG. 10 is a fragmentary section taken along the line 10—10 of FIG. 8.

DESCRIPTION OF THE PREFERRED EMBODIMENT

Figure 1:
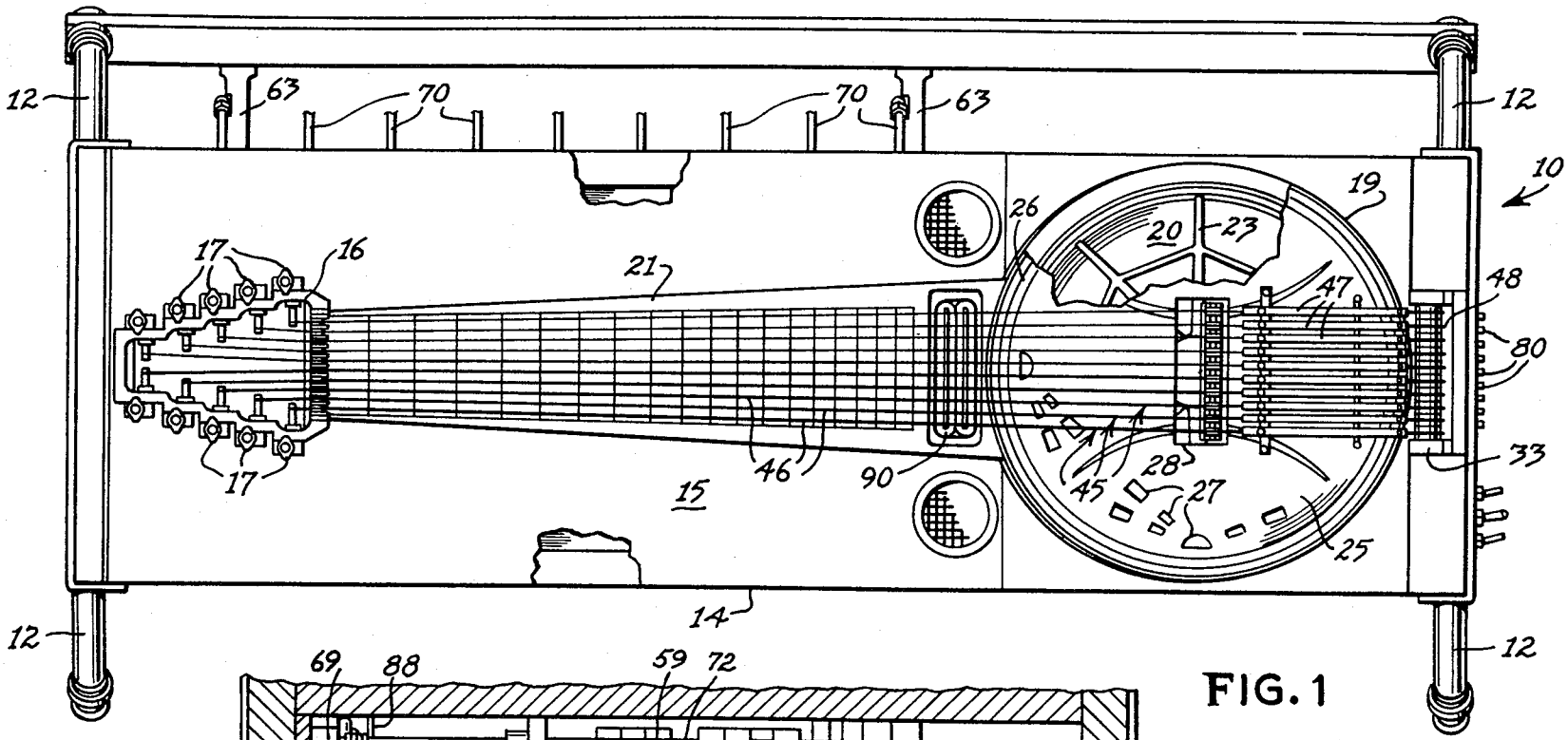
FIG. 1 is a top plan view of the stringed musical instrument made in accordance with this invention, with portions broken away.
Figure 7:
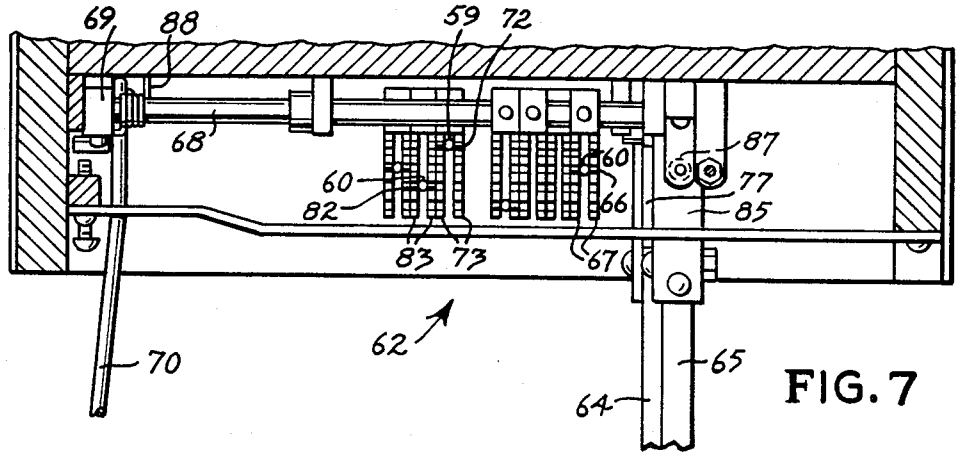
FIG. 7 is an enlarged fragmentary section taken along the line 7—7 of FIG. 4.
Figure 3:
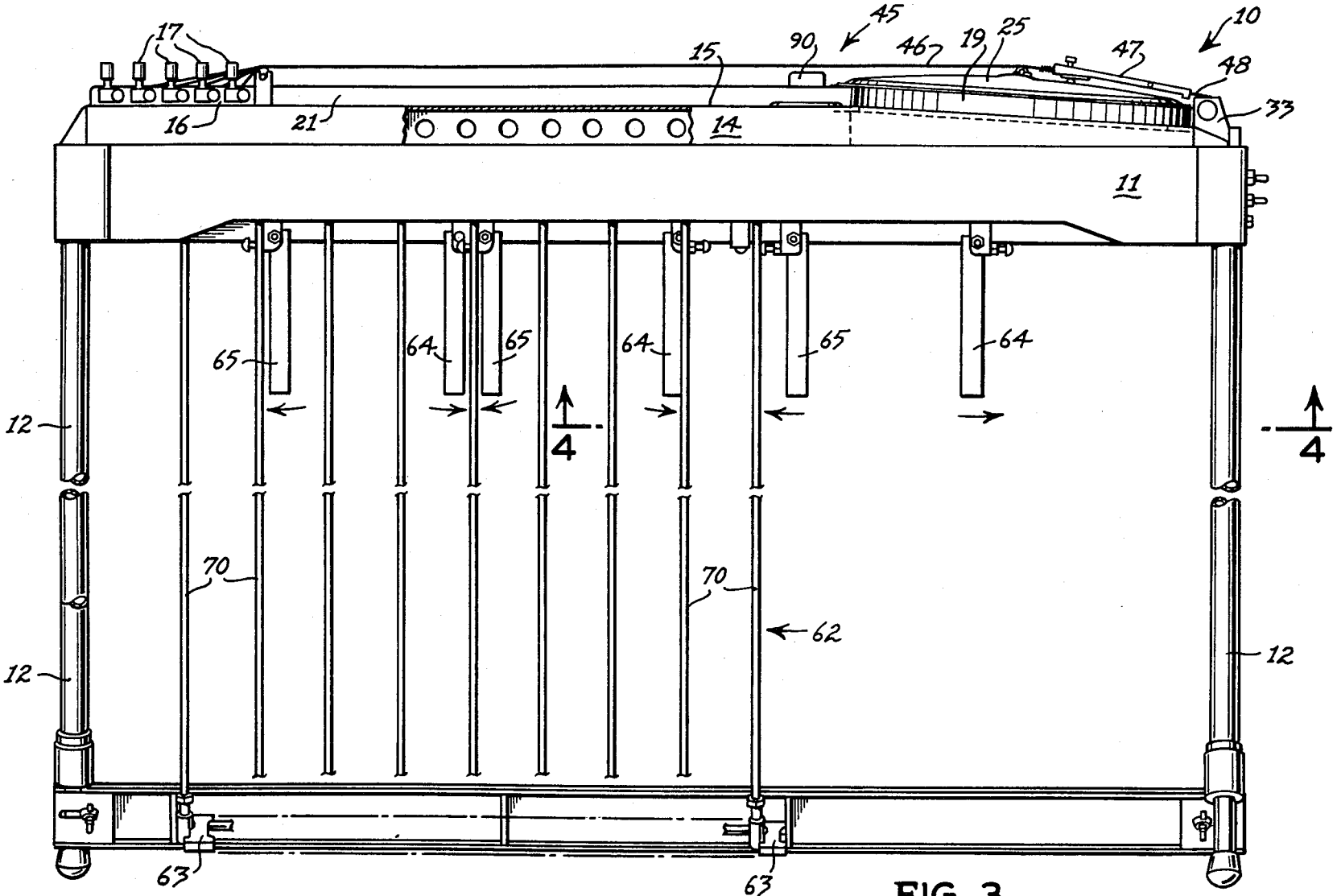
FIG. 3 is a front elevation of the instrument disclosed in FIG. 1, with portions broken away.

Referring now to the drawings in more detail, FIGS. 1, 2 and 3 disclose a stringed musical instrument 10 of the guitar resonator type, made in accordance with this invention, including an elongated substantially rectangular table member 11 supported at its corners by the four legs 12. Fixed on top of the table member 11 is an elongated, hollow body 14 having a top surface 15.

As viewed in FIGS. 1 and 3, mounted on the top surface 15 of the hollow body 14 at the left end portion as viewed in FIGS. 1 and 3, is a head or headpiece carrying a plurality of tuning pegs 17. At the right or tail end portion of the hollow body 14 is a large opening or hole 18 in a resonator frame 19 receiving a dish-shaped resonator 20 of conventional construction. Extending between the resonator frame 19 and the head 16 is an elongated fret board 21. The resonator 20 is provided with a supporting spider frame 23 including a transverse bridge support bar 24.

A disc-shaped resonator cover 25 spans the hole 18 and covers the resonator 20. The cover member 25 has a rim 26 which is secured and supported by the perimeter of the resonator frame 19 surrounding the hole 18. No part of the cover member 25 is supported by any portion of the resonator 20. The resonator cover 25 includes a plurality of perforations 27 and an elongated slot 28 directly above the bridge support bar 24. Secured to the bridge support bar 24 is an upstanding transverse bridge bar 29 supporting a plurality of transversely spaced, vertical, bridge rollers or wheels 30 supported for independent rotary movement upon a transverse shaft or axle 31.

A tuning shaft 32 is fixed to a pair of transversely spaced stanchions or standards 33 upon the tail end portion of the table member 11 adjacent the tail end of the hollow body 14. The tuning shaft 32 is substantially parallel to the bridge bar 29, and about the same length as the bridge bar 29.

Figure 6:
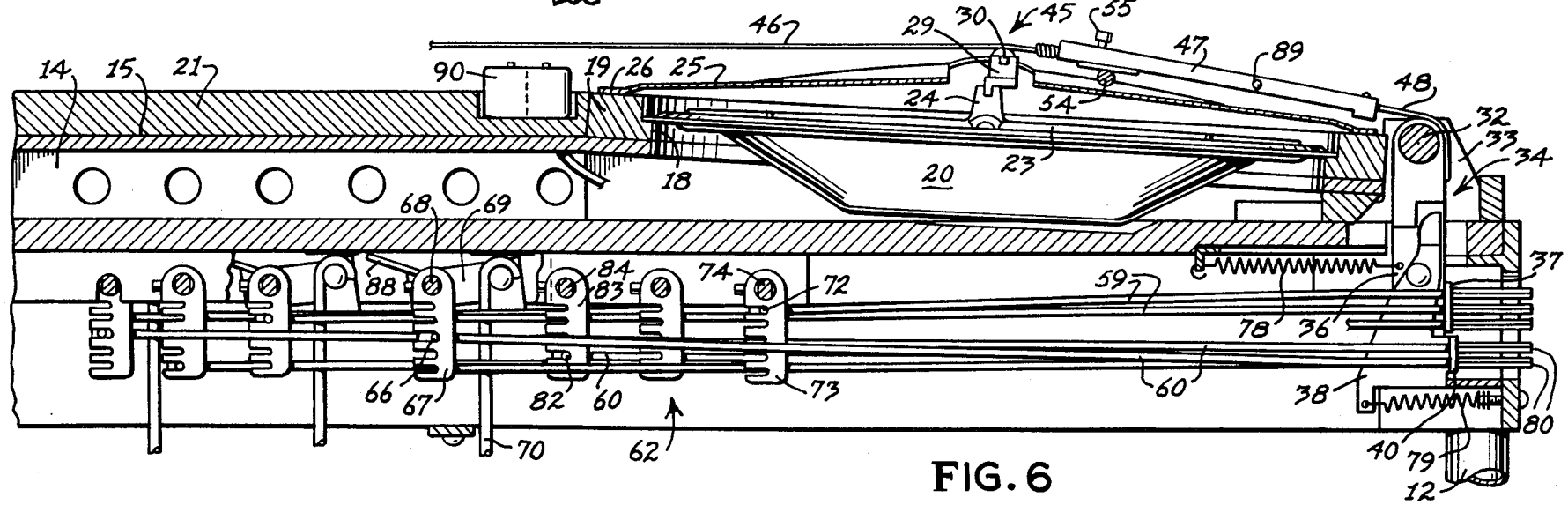
FIG. 6 is an enlarged fragmentary section taken along the line 6—6 of FIG. 4, with portions broken away.

Rotatably supported upon the tuning shaft 32 are a plurality of tuning lever members 34, (FIGS. 6, 8 and 10). Each tuning lever member 34 includes a tuning arm 35 journaled upon and depending from the tuning shaft 32. The tuning lever member 34 also includes an elongated first toggle member or arm 36 also journaled to the tuning shaft 32 and depending closely adjacent the tuning arm 35. The rear edge of the lower portion of the toggle member 36 includes a transverse connector flange 37 having a plurality of apertures, each of which is adapted to receive an elongated connecting rod or wire 59. The lever member 34 further includes a second toggle member 38 which is pivotally connected to the first toggle member 36 by a pivot pin 39 above the connector flange 37. The lower rear edge portion of the second toggle member or arm 38 is also provided with a transverse connector flange 40 below the connector flange 37. The upper end of the second toggle member 38 is provided with an upper projection or latch tongue 41 adapted to engage a latch abutment member 42 projecting downward from the tuning arm 35. The second connector flange 40 is also provided with plurality of holes or apertures for receiving elongated connecting rods or wires 60.

Extending longitudinally over the fret board 21, the resonator 20, and the tuning shaft 32 are a plurality of elongated string members 45. Each string member 45 includes an elongated musical string 46 of conventional construction and material for conventional stringed musical instruments. However, the strings 46 do not extend the full length of the instrument 10 and are relatively shorter than are conventionally required for a conventional stringed musical instrument, such as an electric guitar. As disclosed in the drawings, and particularly FIGS. 1 and 3, the strings 46 extend from the head 16 over the bridge bar 29 and engaging the corresponding bridge rollers 30, to a position slightly rearward of the bridge bar 29. The head ends of the strings 46 are connected to corresponding individual pegs 17 in a manner conventional for stringed musical instruments.

However, each string member 45 , in addition to the musical string 46, includes an elongated rigid string bar 47 and a string cable 48.

The tail end of the string 46 is looped around a tiny spool-like connector piece 49 and then wrapped upon itself to form the coil winding 50 to secure the string 46 to the connector piece 49. The connector piece 49 is then inserted into a key-way slot 51 in the head end of the rigid string bar 47, as best disclosed in FIGS. 8 and 9. The connector piece 49 may be retained in place by a bearing plate 52 secured to the bottom of the string bar 47 by a screw 53.

The bottom surface of each of the bearing plates 52 is adapted to rest upon a transverse support rod 54 transversely fixed to the resonator cover 25. Each bearing plate 52 may be moved toward and away from the string bar 47 by an adjustment set screw 55 in order to vary the elevation of the string bar 47 relative to the support rod 54. The bearing plate 52 is permitted to move relative to the string bar 47 because of the play or loose connection between the screw 53 and the bearing plate 52, or because of the elastic material from which the bearing plates 52 may be made.

The head ends of the string cables 48 are inserted into corresponding openings in the tail ends of the string bars 47 and secured in fixed position by the set screws or clamp screws 57. Each of the flexible string cables 48 extends around and in engagement with the rounded surface of each of the tuning arms 35, as illustrated in FIGS. 6 and 8. The tail ends of the string cables 48 extend to corresponding openings in the rear surface of each of the tuning arms 35 and is secured therein by corresponding clamp screws 58.

As best disclosed in FIGS. 6 and 8, the transverse support rod 54 is fixed at an elevation relative to the bridge bar 29 and the tuning shaft 32 which will permit each of the musical strings 46 and its corresponding string bar 47 to extend in substantially a straight line. Each of the stringed bars 47 is not only rigid but of substantially greater cross-sectional area than its corresponding string 46. Thus, the pressure exerted by any of the string members 45 against the hollow body 14 or cover 25 will be borne subtantially entirely by the transverse rod 54 and the tuning shaft 32. Because the transverse support rod 54 is fixed to the cover 25 and the cover 25 is solidly supported by the perimeter of the resonator frame 19, instead of the resonator 20, substantially little pressure is exerted by any of the strings members 45 against the resonator 20. Any sound conducted from the vibrating string 28 will be conducted through the corresponding bridge roller 30, bridge bar 29, bridge support bar 24 to the resonator 20, in order to improve the tonal quality of the instrument 10.

Each of the tuning levers 34 is designed to rotate the tuning arm 35 in either rotary direction about the tuning shaft 32 in order to either raise or lower the tone of its corresponding string member 45. The direction of rotation of the tuning arm 35 is dependent upon which of the connector flanges 37 or 40 is pulled to the left in FIGS. 6 and 8 by its corresponding elongated connecting rod 59 or 60. The connecting rods 59 and 60 form a part of a linkage assembly 62 which is used in conventional pedal steel guitars and are ultimately controlled by corresponding pedals 63 and knee levers 64 and 65.

One of the rods 60, as disclosed in FIG. 6 is connected at its left end by a pin member 66 to a depending lever arm 67, which in turn is connected to a transverse pivot shaft 68. The rear end of the pivot shaft 68 carries a rear arm 69 which is connected to a depending pedal connecting rod 70, which in turn is connected to a corresponding pedal 63. Thus, when that particular pedal 63 is depressed, the connector flange 40 is pulled to the left causing the corresponding second toggle member to pivot clockwise about the pivot pin 39 relieving the pressure between the locking tongue 41 and the abutment member 42, thereby permitting the tension in the string member 45 to rotate the tuning arm 35 in a counter clockwise motion about the tuning shaft 32. Thus, the depression of that particular pedal 63 will relieve the tension in the corresponding string 46 to lower the tone of that particular string.

Figure 5:
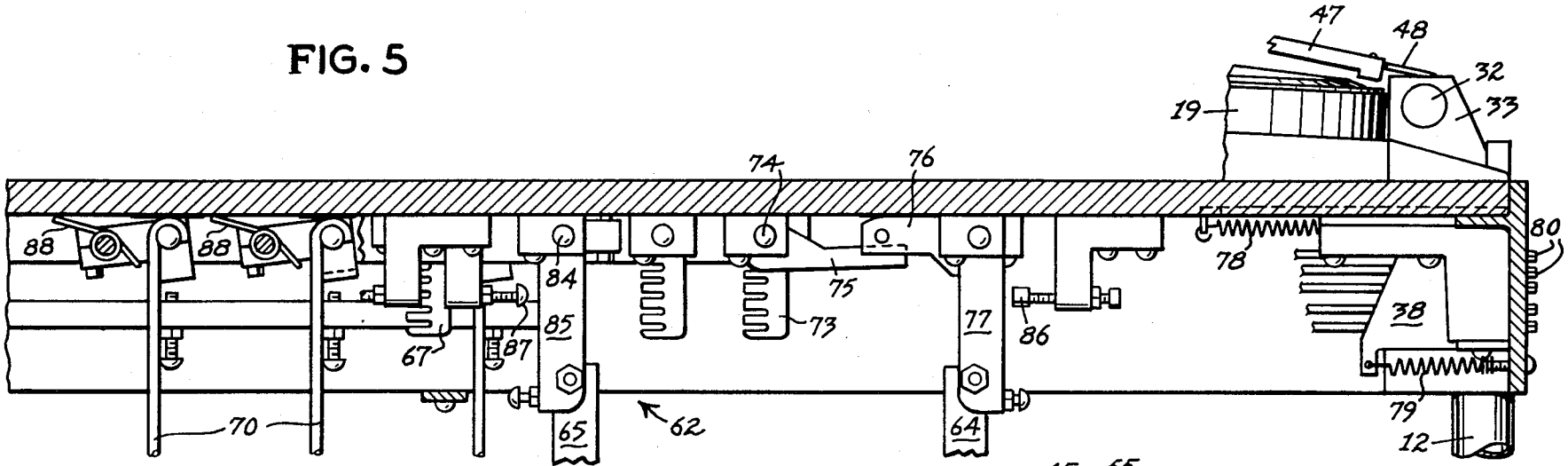
FIG. 5 is an enlarged fragmentary section taken along the line 5—5 of FIG. 4, with portions broken away.

One of the connecting rods 59 from the connector flange 37 terminates in a pin 72 in a depending lever 73 fixed on a transverse shaft 74 carrying a toggle arm 75 pivotally connected to toggle arm 76 which forms one arm of a bell crank lever 77, which in turn is pivotally connected to the knee lever 64, as illustrated in FIG. 5. Thus, movement of the knee lever 64 to the right, as illustrated by the arrow in FIG. 3, will cause that particular rod 59 to pull the connector flange 37 and the first toggle member 36 toward the left of FIGS. 6 and 8 causing the entire lever member 34, including the tuning arm 35, to rotate clockwise and tighten the corresponding string 46, in order to raise the tone of that string.

In a similar manner, another connecting rod 60 terminates at its left end, in FIG. 6, in a connector pin 82 in a depending lever 83 secured to a transverse rotary shaft 84. Fixed to the transverse shaft 84 is a depending arm 85 to which the knee lever 65 is pivotally connected, (FIG. 5). This linkage permits the knee lever 65 to be rotated to the left, in FIG. 3, in order to pull the flange 40 to the left, thereby tightening or tensioning the corresponding string 45 and elevating the tone of that particular string.

The depending arms 77 and 85 of the knee levers 64 and 65 may be provided with stops 86 and 87, as illustrated in FIG. 5. The transverse rotary shaft 68 in the pedal linkages may be provided with counter-rotating spring members 88, if desired.

Each of the first toggle members 36 is rotatably biased about the tuning shaft 32 in a clockwise direction by a spring 78, while each of the second toggle members 38 is rotatably biased about the tuning shaft 32 and pivot pin 39 in a counter-clockwise direction by a spring 79.

Each of the connector rods 59 and 60 has its right end threaded and connected to an adjustment head 80 in order to individually adjust the lengths of the connecting rods 59 and 60, and therefore the tonal quality of the instrument 10.

A safety or tie wire 89 may be inserted transversely through corresponding holes in the string bar 47, in order to secure the string bars 47 loosely together. Thus, if a single musical string 46 breaks, its corresponding string bar will be tied to the other string bars 47, to prevent any single string bar from snapping rapidly upward, and possibly injuring the performer.

It will therefore be apparent that a stringed musical instrument of the guitar resonator type adapted to be played upon a horizontal table is provided with a string structure, which in essence shortens the effective length of the string, but also provides a string structure which removes substantial load and pressure from the vibrating musical string per se. The invention made in accordance with this invention also reduces the string breakage by eliminating the chafing contact between the musical strings and the bridge.

Furthermore, the tonal qualities of the instrument are improved by the substantial elimination of string pressure against the resonator.

Because of the effective shortening of the length of the musical string 46, the occurrence of overtones is reduced. Moreover, the travel of the pedal or knee lever is slightly reduced in changing the tension on the strings to produce different tones. Such reduced action occurs because of the greater catenary or sag of a longer string than a shorter string.

Also in a preferred form of the invention, the top surface of the resonator frame 19 is sloped gradually downward toward the tail end of the instrument as clearly illustrated in FIGS. 3, 6, and 8. Such sloping not only improves the appearance of the instrument, but also slightly shortens the overall length of the string member 45.

Figure 4:
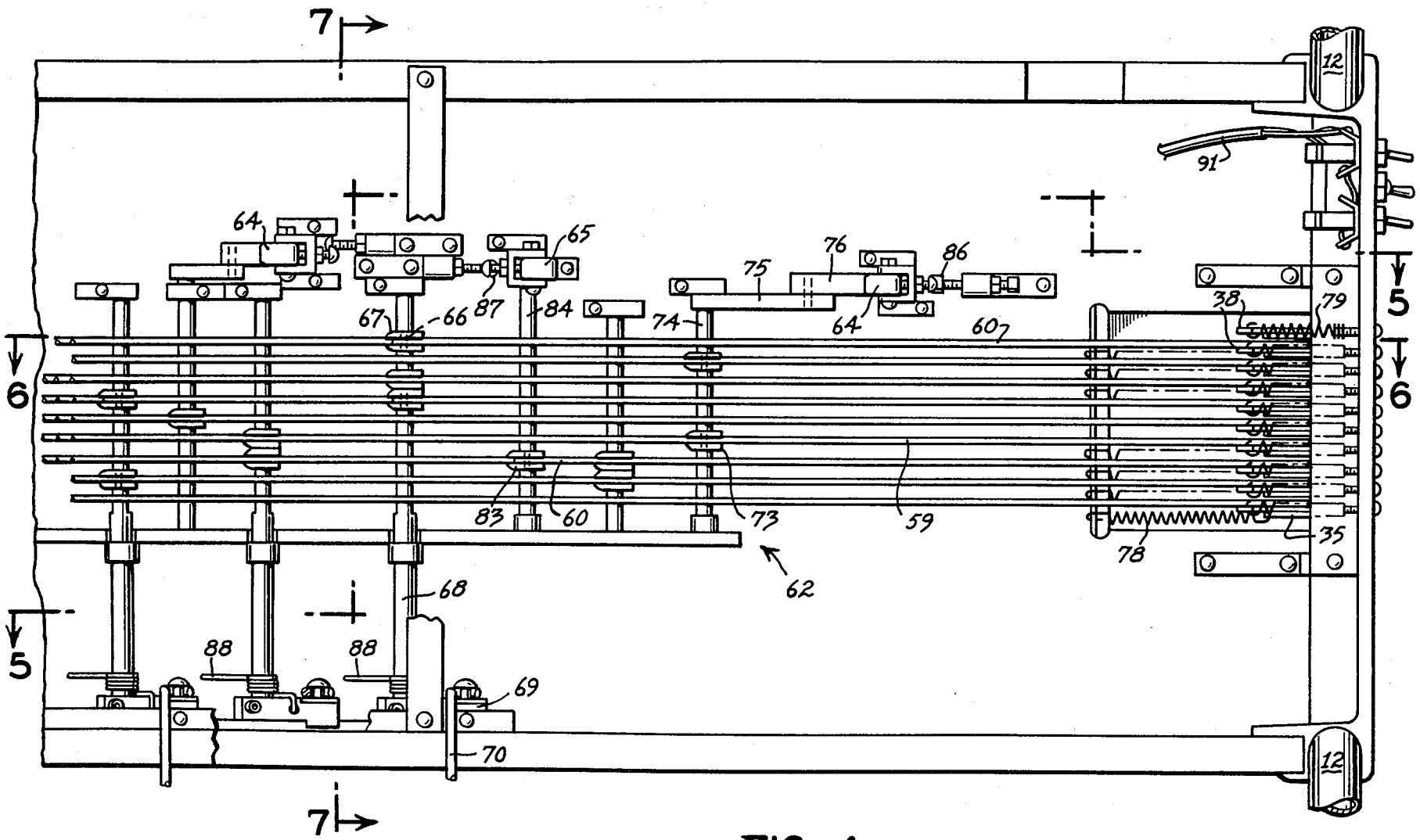
FIG. 4 is an enlarged fragmentary bottom plan section taken along the line 4—4 of FIG. 3.

The musical instrument 10, made in accordance with this invention, may be used either as an acoustic or an electrical guitar type instrument. For electrical use, an electrical pick-up 90 is incorporated between the fret board 21 and the resonator frame 19 (FIGS. 1, 3 and 6), and conventional electrical circuitry 91 (FIG. 4) and an amplifier, not shown, is utilized.

What is claimed is:

1. A stringed musical instrument comprising:

(a) an elongated hollow body having head and tail end portions and top and bottom surfaces, (b) a dished resonator mounted in said top surface adjacent said tail end portion, (c) a transverse bridge fixed on said resonator and projecting above said top surface, (d) a head supporting a plurality of adjustable string pegs on said top surface adjacent said head end portion, (e) an elongated fret board on said top surface extending from said head to said resonator, (f) a tuning shaft, (g) means supporting said tuning shaft on said tail end portion transversely of said body, spaced from and parallel to said bridge, (h) a plurality of tuning lever members supported on said tuning shaft for independent pivotal movement on said tuning shaft, (i) a transverse support rod fixed transversely over said resonator, spaced parallel to and between said bridge and said tuning shaft, (j) a plurality of elongated string members, each string member comprising an elongated string and an elongated rigid string bar, (k) the head end of each of said strings being connected to a corresponding string peg, said strings extending longitudinally over said fret board and over and against said bridge, in an operative position, (l) means connecting each of said string bars to a corresponding tuning lever member, (m) said string bars extending over and bearing against said transverse support rod in said operative position, (n) the relative height of said support bar and said bridge being such as to minimize the pressure exerted by said strings against said bridge, and (o) actuator means operatively connected to said tuning lever members to pivot said tuning lever members about said tuning shaft to vary the tension in said corresponding strings.

2. The invention according to claim 1 further comprising adjustment means mounted on each of said string bars and cooperative with said corresponding support rod to move said corresponding string bar toward and away from said support rod to vary the pressure of said corresponding string against said bridge.

3. The invention according to claim 1 in which said bridge comprises a plurality of transversely spaced, coaxial bridge rollers, said strings bearing against said bridge rollers.

4. The invention according to claim 1 further comprising a table supporting said elongated hollow body, said actuator means comprising a plurality of pedals pivotally mounted on said table, link means connecting said pedals to said tuning lever members, whereby pivotal movement of said pedals causes corresponding pivotal movement of said tuning lever members.

5. The invention according to claim 4 in which said actuator means further comprises knee levers pivotally mounted on said table and knee link means connecting said knee levers to some of said tuning lever members whereby pivotal movement of said knee levers causes corresponding pivotal movement of said tuning lever members.

6. The invention according to claim 5 in which each of said tuning lever members comprises a tuning arm, means connecting each of said string bars to a corresponding tuning arm, first and second toggle members operatively associated with said tuning arm, said link means comprising a first link rod connected to said first toggle member and a second link rod connected to said second toggle member, said link rods being operatively connected to said pedals and knee levers, whereby actuation of said first link rod causes said tuning arm to rotate in one direction about said tuning shaft to create tension in said corresponding string and actuation of said second link rod causes said tuning arm to counter-rotate about said tuning shaft to reduce tension in said corresponding string.

7. The invention according to claim 6 in which said first toggle member is elongated and freely and pivotally mounted upon said tuning shaft adjacent said tuning arm, and said second toggle member is pivotally connected to said first toggle member and has an upstanding latch tongue engaging said tuning arm, spring means biasing said latch tongue into engagement with said tuning arm.

8. The invention according to claim 7 further comprising counter-spring means biasing said first toggle member in a direction to create tension in said corresponding string.

9. The invention according to claim 1 in which said elongated hollow body is generally rectangular and in which the portion of said top surface supporting said resonator tapers downward toward said tail end portion, the portion of said top surface supporting said fret board and said head being substantially horizontal.

10. The invention according to claim 1 in which each of said strings is substantially straight in said operative position.

11. The invention according to claim 1 further comprising a perforated cover spanning and covering the top portion of said resonator, said bridge projecting above said cover, and said transverse support rod being fixed upon said cover.

* * * * *